US008408866B2

(12) United States Patent
Weaver et al.

(10) Patent No.: US 8,408,866 B2
(45) Date of Patent: Apr. 2, 2013

(54) APPARATUS AND METHOD FOR COOLING A TURBINE AIRFOIL ARRANGEMENT IN A GAS TURBINE ENGINE

(75) Inventors: John Alan Weaver, Indianapolis, IN (US); Tony Alan Lambert, Brownsburg, IN (US); James Sellhorn, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 851 days.

(21) Appl. No.: 12/313,063

(22) Filed: Nov. 17, 2008

(65) Prior Publication Data

US 2010/0124483 A1 May 20, 2010

(51) Int. Cl.
*F01D 5/18* (2006.01)
*F01D 5/08* (2006.01)
*F04D 27/02* (2006.01)

(52) U.S. Cl. ..... 415/115; 415/1; 416/95; 416/232; 416/1

(58) Field of Classification Search ..... None
See application file for complete search history.

(56) References Cited

U.S. PATENT DOCUMENTS

| | | | | |
|---|---|---|---|---|
| 2,896,906 | A | 7/1959 | Durkin | |
| 4,721,433 | A | 1/1988 | Piendel et al. | |
| 5,387,085 | A | 2/1995 | Thomas, Jr, et al. | |
| 5,488,825 | A | 2/1996 | Davis et al. | |
| 5,669,759 | A | 9/1997 | Beabout | |
| 5,795,130 | A * | 8/1998 | Suenaga et al. | 416/95 |
| 6,036,441 | A | 3/2000 | Manning et al. | |
| 6,065,932 | A | 5/2000 | Dodd | |
| 6,094,905 | A | 8/2000 | Fukuyama | |
| 6,195,979 | B1 | 3/2001 | Fukuyama | |
| 6,220,817 | B1 | 4/2001 | Durgin et al. | |
| 6,241,467 | B1 | 6/2001 | Zelesky et al. | |
| 6,280,140 | B1 | 8/2001 | Soechting et al. | |
| 6,290,464 | B1 * | 9/2001 | Negulescu et al. | 416/97 R |
| 6,422,811 | B1 * | 7/2002 | Beeck et al. | 415/115 |
| 6,427,448 | B1 | 8/2002 | Reichert | |
| 6,431,832 | B1 | 8/2002 | Glezer et al. | |
| 6,607,355 | B2 | 8/2003 | Cunha et al. | |
| 6,779,597 | B2 | 8/2004 | DeMarche et al. | |
| 6,832,889 | B1 | 12/2004 | Lee et al. | |
| 7,131,813 | B2 * | 11/2006 | Tiemann | 415/115 |

(Continued)

FOREIGN PATENT DOCUMENTS

| | | | |
|---|---|---|---|
| DE | 196 29 191 | A1 | 7/1996 |
| EP | 1 306 521 | A1 | 5/2003 |

(Continued)

OTHER PUBLICATIONS

International Search Report, PCT/US2009/064789, Jan. 12, 2010, Rolls-Royce Corporation.
European Search Report, EP 09826971.5, Rolls-Royce Corporation, May 25, 2012.

*Primary Examiner* — Scott B Geyer
(74) *Attorney, Agent, or Firm* — Krieg DeVault LLP

(57) ABSTRACT

A turbine airfoil arrangement for a gas turbine engine includes an airfoil having an inlet and an exit, the inlet configured to receive a cooling gas flow operable to cool at least part of an other airfoil; and a passage disposed in the airfoil and fluidly coupled to the inlet and the exit, the exit being configured to pass at least some of the cooling gas flow to the other airfoil.

15 Claims, 5 Drawing Sheets

U.S. PATENT DOCUMENTS

| | | | | |
|---|---|---|---|---|
| 2002/0148233 | A1 | 10/2002 | Tiemann | |
| 2003/0035717 | A1 | 2/2003 | Tiemann | |
| 2005/0025614 | A1 | 2/2005 | Tiemann | |
| 2006/0280607 | A1 | 12/2006 | Harvey et al. | |
| 2009/0010751 | A1* | 1/2009 | McCaffrey et al. | 415/116 |

FOREIGN PATENT DOCUMENTS

| | | | |
|---|---|---|---|
| EP | 1 033 484 | B1 | 11/2006 |
| EP | 2 011 968 | A2 | 1/2009 |

* cited by examiner

APPARATUS AND METHOD FOR COOLING A TURBINE AIRFOIL ARRANGEMENT IN A GAS TURBINE ENGINE

GOVERNMENT RIGHTS IN PATENT

The invention described herein was made under U.S. government contract no. N00019-04-C-0102. The U.S. government may have certain rights in this patent.

FIELD OF THE INVENTION

The present invention relates generally to gas turbine engines, and, more particularly, to a turbine airfoil arrangement in a gas turbine engine and a method for cooling the same.

BACKGROUND OF THE INVENTION

A gas turbine engine, such as a turbofan engine, includes a fan section, a gas generator and a low pressure turbine for powering the fan section using a gas stream generated by the gas generator. For an axial flow machine, the gas generator typically includes a plurality of compressor stages, a combustor and a plurality of high pressure turbine stages downstream of the combustor. Typically, the gas generator receives some of the air that is pressurized by the fan section, compresses it, and passes it to the combustor, where heat is added by combustion. The resulting heated gases are passed to the gas generator turbine, which extracts power to drive the gas generator compressor. The output of the gas generator turbine is then supplied to the low pressure turbine, which extracts mechanical power for driving the fan section.

In order to increase the power output and efficiency of the gas turbine engine, it is desirable to supply the gases from the combustor at or near stoichiometric temperature for the fuel mixture. This typically requires the use of both sophisticated materials and cooling schemes, such as where cooling air is bled from the compressor and supplied to selected turbine airfoils and gas path components downstream of the combustor for cooling. The cooling of the turbine components, such as convection, impingement and film cooling, reduces the metal temperature of those turbine components, thereby reducing the degradation of material properties due to, for example, temperature and oxidative damage. Although the cooling air may thereby allow higher operating temperatures of the engine, the cooling air is also parasitic to the engine, since it is not directly used to produce power, e.g., thrust, and hence, it is desirable to reduce the amount of cooling air that is used.

The present application provides a novel and non-obvious turbine airfoil arrangement for a gas turbine engine and an improved method for cooling the turbine airfoil arrangement.

SUMMARY OF THE INVENTION

One embodiment is a unique turbine airfoil arrangement. Other embodiments include unique methods and apparatus associated with turbine airfoils and turbine airfoil arrangements. Further embodiments, forms, objects, features and aspects shall become apparent from the following descriptions and drawings.

DETAILED DESCRIPTION OF THE INVENTION

Figure 1:
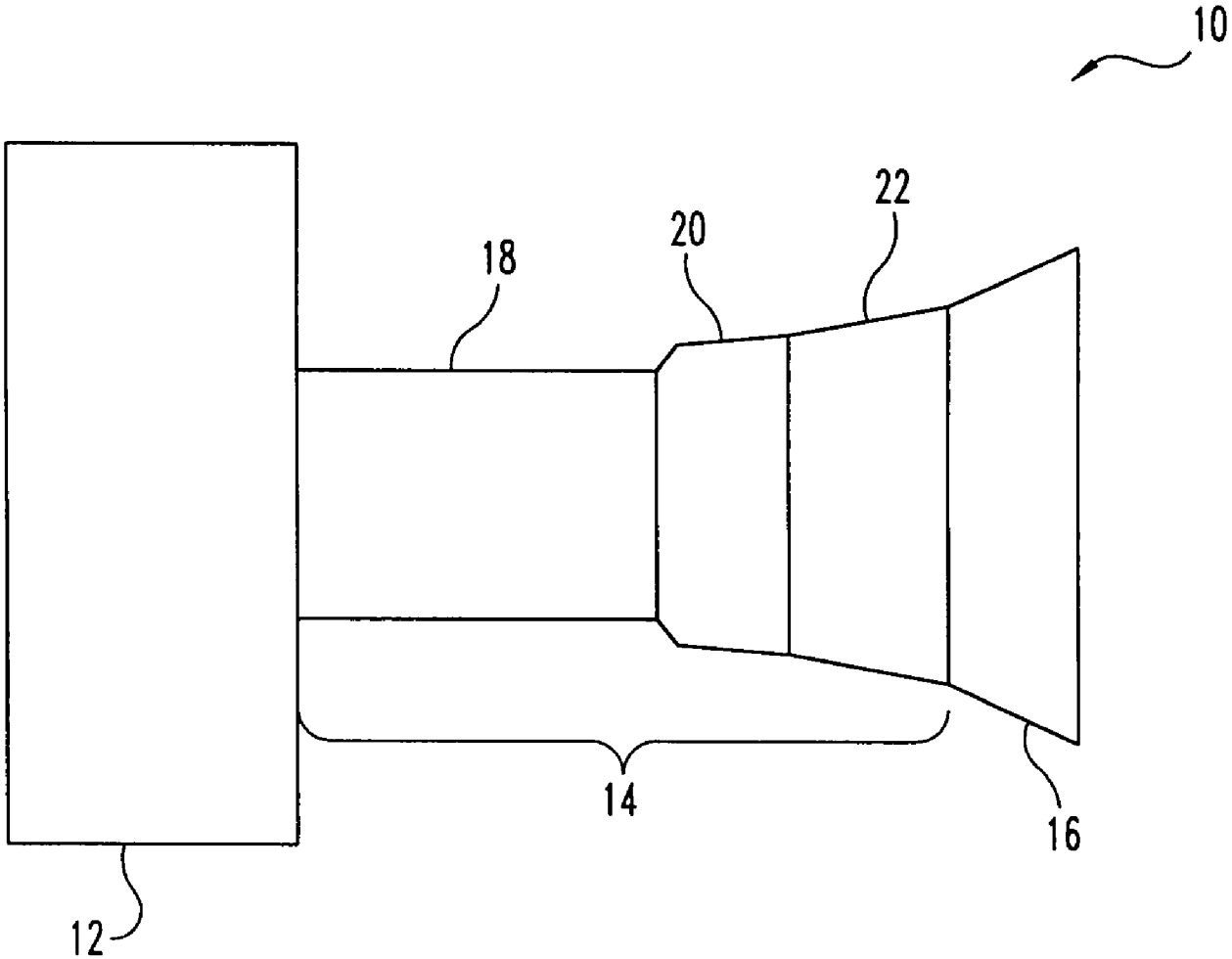
FIG. 1 is a schematic depiction of a gas turbine engine employed in accordance with an embodiment of the present invention.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings and particularly to FIG. 1, there is schematically shown a turbofan engine 10. Engine 10 includes a fan section 12, a gas generator 14 and a low pressure turbine 16. Gas generator 14 includes a compressor 18, combustor 20 and a gas generator turbine 22. Although described herein as a turbofan engine, it will be understood that the present invention is equally applicable to an engine 10 in the form of a turboshaft engine, a turboprop engine, a turbojet engine, or any gas turbine engine having an axial turbine, a radial turbine, or a combination thereof. Accordingly, it will be understood that the present invention is not limited to use in turbofan engines.

Fan section 12 is fluidly coupled to compressor 18 for delivering a portion of the air that passes through fan section 12 to compressor 18. Compressor 18 is mechanically coupled to gas generator turbine 22. Combustor 20 is fluidly disposed between compressor 18 and turbine 22, and is configured to supply fuel to the air discharged by compressor 18, combust the fuel/air mixture, and provide the combustion products in the form of hot gases to turbine 22. Low pressure turbine 16 is fluidly coupled to gas generator turbine 22 for receiving the gases discharged from turbine 22, and is mechanically coupled to fan section 12 to provide power to drive fan section 12.

Figure 2:
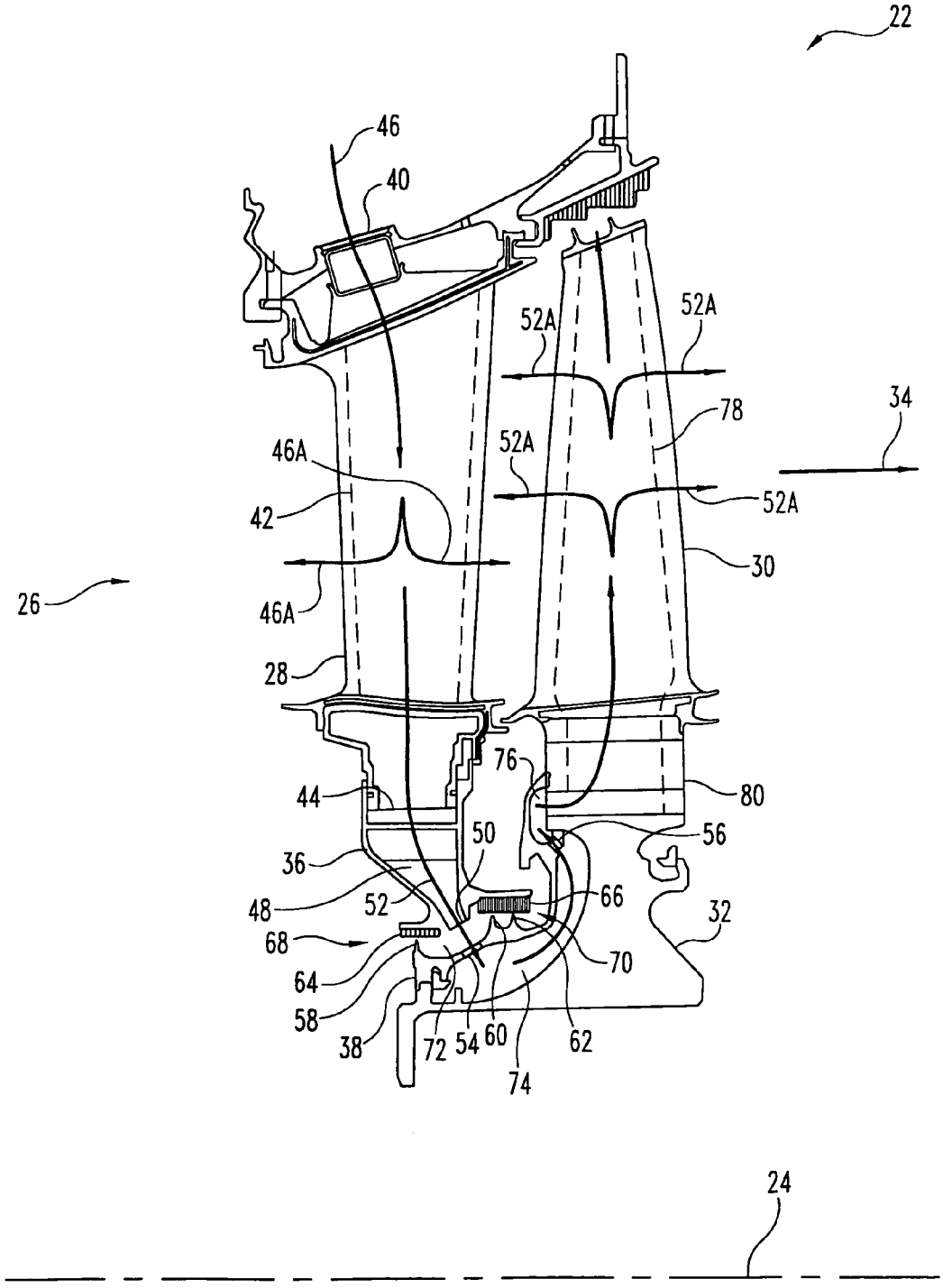
FIG. 2 depicts a turbine airfoil arrangement in accordance with an embodiment of the present invention.

Referring now to FIG. 2, a portion of gas generator turbine 22 above an engine 10 centerline 24 is depicted in cross section. Gas generator turbine 22 includes an airfoil arrangement 26, which includes a plurality of turbine vanes, such as turbine vanes 28, and a plurality of turbine blades, such as turbine blades 30, retained in a turbine wheel 32 of gas generator turbine 22. Turbine blades 30 are located downstream of vanes 28 in a main gas path direction 34. Airfoil arrangement 26 may also include a preswirler 36 and a cover plate 38.

In the present embodiment, vanes 28 and blades 30 are second stage turbine airfoils located downstream from first stage turbine airfoils (not shown) in main gas path direction 34. Although the present embodiment is described with respect to second stage airfoils, it will be understood that the materials described herein are equally applicable to first stage turbine airfoils, a combination of first and second stage airfoils, or any combination of turbine blades and/or vanes across one or more turbine stages.

In the present description, reference is made in the singular to turbine vane 28 and turbine blade 30 for the sake of convenience. Nonetheless, it will be understood that each such reference applies to each turbine vane 28 and turbine blade 30 in airfoil arrangement 26.

Turbine vane 28 includes an inlet 40, a passage 42 and an exit 44. Inlet 40 is fluidly coupled to compressor 18 and configured to receive a cooling gas flow 46 from compressor 18, e.g., via passages (not shown) that are in communication with compressor 18. Cooling gas flow 46 is configured, e.g., in temperature and quantity, to cool at least part of vane 28 and at least part of blade 30. Passage 42 is disposed inside vane 28, and is fluidly coupled to inlet 40 and exit 44. Inlet 40 is configured to receive cooling gas flow 46, which is supplied to passage 42. In the present embodiment, inlet 40 has an orifice area configured to control the amount of cooling gas flow 46 that passes through vane 28, although in other embodiments, the amount of cooling gas flow 46 may be controlled elsewhere, e.g., by the size of exit 44, or an orifice upstream of vanes 28.

Passage 42 is configured to provide cooling of vane 28, e.g., convection cooling and film cooling of its airfoil surfaces, including the leading and trailing edges, as well as the pressure and suction sides of vane 28. For film cooling, passage 42 may include film cooling discharge holes that discharge some of cooling gas flow 46 to the periphery of vane 28, e.g., at the leading and trailing edges, represented in FIG. 2 by arrows 46A.

Preswirler 36 may include a passage 48 having a discharge port 50. Passage 48 is coupled to exit 44, and receives a portion 52 of cooling gas flow 46 that was not discharged into the main gas path for film cooling of vane 28. Passage 48 decreases in area with increasing proximity to discharge port 50 in order to increase the velocity of portion 52 of cooling gas flow 46 as it exits discharge port 50. Discharge port 50 is angled in the direction of rotation of turbine wheel 32 in order to introduce a swirl component into the velocity of the portion 52 of cooling gas flow 46 being discharged through discharge port 50 so as to reduce losses that may occur in supplying portion 52 of cooling gas flow 46 from the stationary vane 28 to the rotating blade 30.

Cover plate 38 may be attached to turbine wheel 32, and may include a plurality of openings 54 and a plurality of openings 56. In the present embodiment, cover plate 38 is configured to axially retain blade 30 in turbine wheel 32, and to direct portion 52 of cooling gas flow 46 to blade 30.

Knives 58, 60 and 62 may be formed on cover plate 38 adjacent corresponding stators 64 and 66 disposed on preswirler 36 to form a knife seal 68 and a labyrinth seal 70. Seals 68 and 70 form an annular cavity 72 disposed between the stationary preswirler 36 and the rotating cover plate 38. Cavity 72 is in fluid communication with exit 44 via preswirler 36. An annular cavity 74 and an annular cavity 76 are formed between cover plate 38 and turbine wheel 32.

In one form, turbine blade 30 includes a passage 78 and an attachment 80 configured to attach blade 30 to turbine wheel 32. Passage 78 is disposed in blade 30, and extends through attachment 80. Passage 78 is fluidly coupled to exit 44 of vane 28 via preswirler 36, cavities 72, 74 and 76, and pluralities of openings 54 and 56. Passage 78 is configured to receive portion 52 of cooling gas flow 46 directed thereto by cover plate 38, and to cool at least part of blade 30 using portion 52, such as by convection and film cooling of its airfoil surfaces, including the leading and trailing edges, as well as the pressure and suction sides of blade 30. For film cooling, passage 78 may include film cooling discharge holes (not shown) that discharge some of portion 52 of cooling gas flow 46 to the periphery of blade 30, represented in FIG. 2 by arrows 52A.

During the operation of engine 10, compressor 18 provides pressurized air to combustor 20, which adds fuel to the air, ignites the fuel/air mixture, and supplies the hot combustion gases to turbine 22. Shaft power is extracted from the hot gases by turbine 22, which is used to drive compressor 18. The exhaust from turbine 22 is supplied to low pressure turbine 16, which extracts sufficient shaft power to drive fan 12.

In order to operate engine 10 at relatively high turbine inlet temperatures, it is desirable to employ a cooling scheme whereby air is bled from compressor 18 and used to cool selected turbine 22 airfoils. In the present embodiment, a cooling scheme is used to cool turbine vane 28 and turbine blade 30 in serial fashion, as described below.

Figure 3:
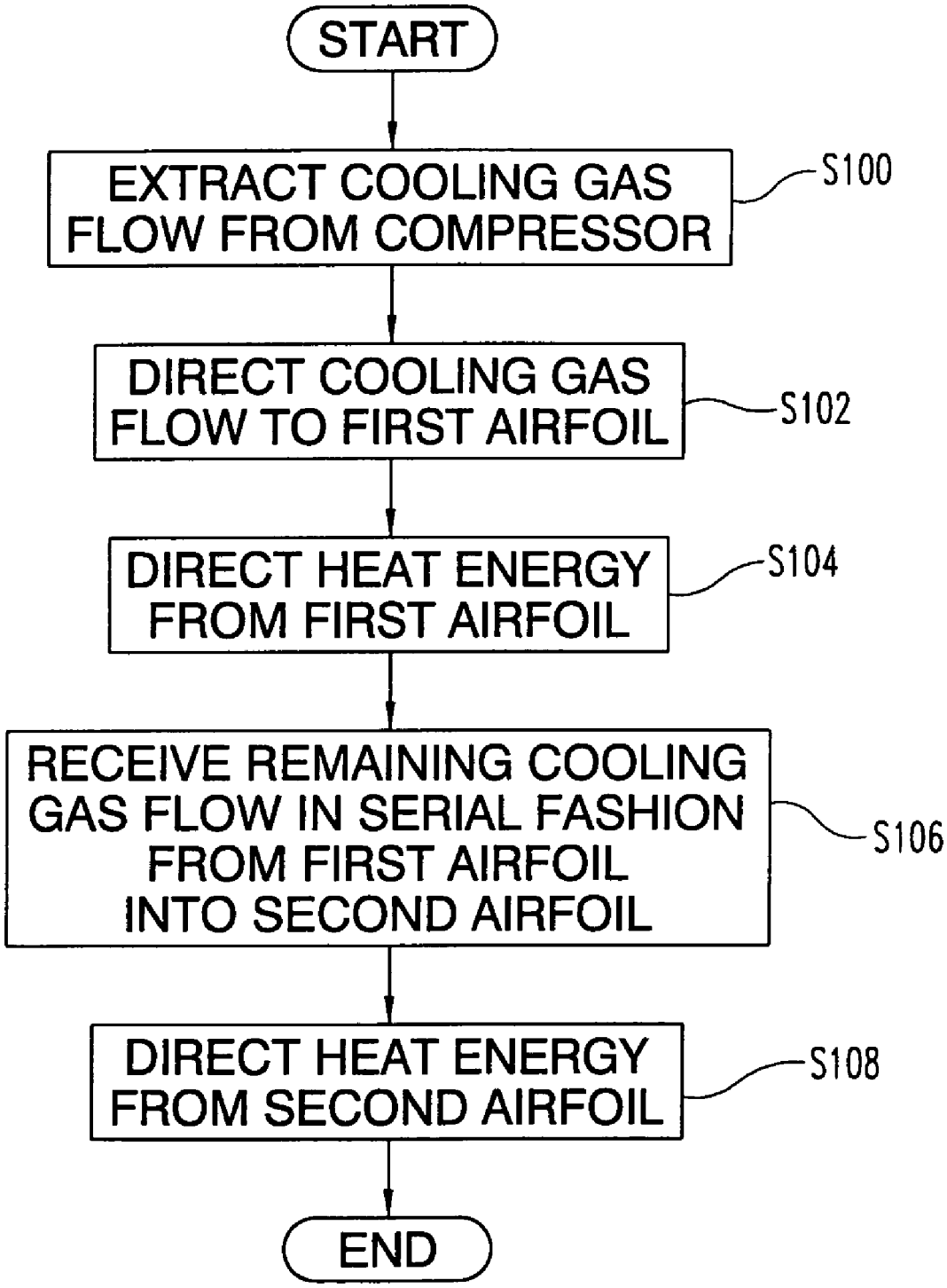
FIG. 3 is a flowchart depicting a method of cooling turbine airfoil arrangement of a gas turbine engine in accordance with the embodiment of FIG. 2.
Figure 4:
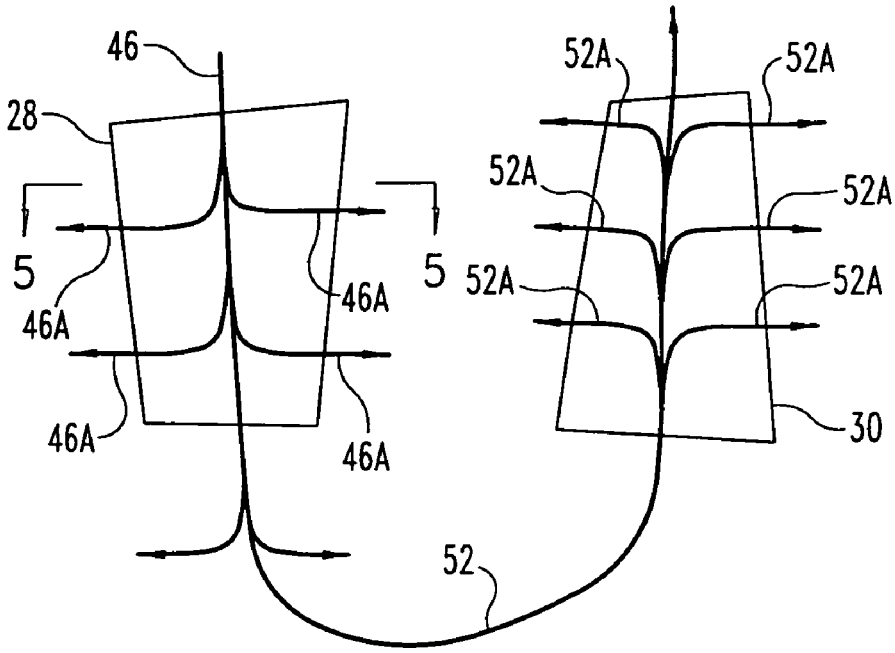
FIG. 4 schematically depicts a process of cooling a turbine vane and a turbine blade in serial fashion as an aid to the description of the method of FIG. 3.
Figure 5:
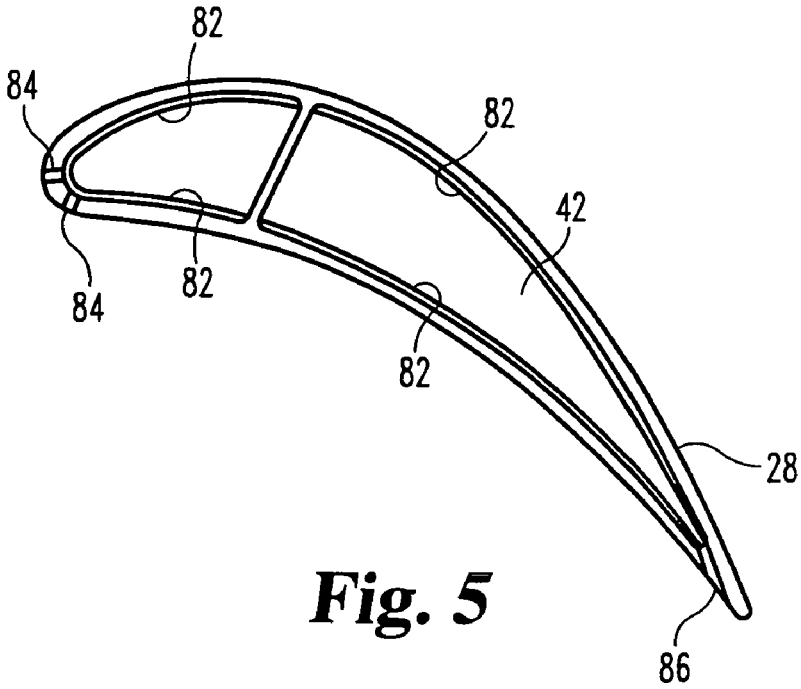
FIG. 5 depicts a cross section of a turbine vane illustrating turbulators and film cooling holes in accordance with the embodiment of FIGS. 2-4.

Referring now to FIG. 3, in conjunction with FIGS. 4 and 5, a method of cooling turbine airfoil arrangement 26 in accordance with an embodiment of the present invention is depicted with respect to acts S100-S108, which desirably preserve the material properties of the alloys and coatings from which turbine vane 28 and turbine blade 30 are made, as well as to reduce oxidation corrosion.

At step S100, cooling gas flow 46 is extracted from compressor 18, e.g., via a bleed port (not shown). Cooling gas flow 46 is configured in both temperature and quantity, e.g. flow rate, to provide cooling to both turbine vane 28 and turbine blade 30.

At step S102, cooling gas flow 46 is directed by engine 10 plumbing (not shown) to turbine vane 28, as depicted in FIG. 4. In the present embodiment, cooling gas flow 46 is directed to inlet 40 of turbine vane 28 and is received internally by passage 42.

At step S104, heat energy is directed away from turbine vane 28 with cooling gas flow 46. For example, with reference to FIG. 5, turbine vane 28 may include turbulators 82 that induce turbulence in cooling gas flow 46 to increase the convective heat transfer from turbine vane 28. In the present embodiment, turbulators 82 are in the form of ribs oriented approximately perpendicular to the direction of flow of cooling gas flow 46, e.g., extending in the chordwise direction in passage 42 and spaced apart in the spanwise direction. In addition, turbine vane 28 may include film cooling holes distributed along the span of turbine vane 28, such as leading edge film cooling holes 84 and trailing edge film cooling holes 86. Leading edge film cooling holes 84 and trailing edge film cooling holes 86 discharge some of cooling gas flow 46 into the main gas path in order to provide a layer of cooling gas to the surfaces of the leading edge and trailing edge of turbine vane 28. Additional cooling schemes may be employed without departing from the scope of the present invention, for example, using heat transfer pins/fins, impingement tubes, and other types of cooling schemes.

At step S106, the remaining portion 52 of cooling gas flow 46 is received in serial fashion from exit 44 of turbine vane 28 into turbine blade 31, which is positioned downstream in main gas path direction 34 from turbine vane 28. As used herein, the term "serial fashion" means that cooling gas flow 46 is used first to cool one turbine airfoil, e.g., turbine vane 28, and that at least some of the cooling gas flow 46 that exits turbine vane 28, e.g., portion 52, is then used to cool another turbine airfoil, e.g., turbine blade 30. In the present embodiment, the remaining portion 52 of cooling gas flow 46 that is not discharged through film cooling holes 84 and 86 egresses turbine vane 28 via exit 44, and is directed by passage 48 of the preswirler 36 to discharge port 50, which preswirls portion 52 of cooling gas flow 46 for entry into cavity 72 between knife seal 68 and labyrinth seal 70. Some of portion 52 may be used to purge cavity 72 to prevent the ingress of hotter gasses through knife seal 68 and labyrinth seal 70. The balance of portion 52 of cooling gas flow 46 then enters into cavity 74 via openings 54 in cover plate 38, and is directed along cavity 76 into openings 56 of cover plate 38, from where it flows into passage 78 of turbine blade 30.

At step S108, heat energy is directed from turbine blade 30 with portion 52 of cooling gas flow 46, subsequent to directing heat energy away from turbine vane 28 with cooling gas flow 46. The heat energy may be directed from turbine blade 30 in the same manner as with turbine vane 28, e.g., convection and film cooling. Additional cooling schemes may be employed without departing from the scope of the present invention, for example, using pin fins, impingement tubes, and other types of cooling schemes.

As set forth above, an aspect of the present invention includes serially cooling at least two turbine airfoils. By providing cooling gas flow 46 in serial fashion, a greater flow quantity may be employed to cool each of the airfoils individually, but because the cooling gas flow is provided to the airfoil stages in serial fashion, the total amount of cooling gas flow may be reduced, e.g., as compared to a parallel cooling scheme. That is, the amount of cooling gas flow that is provided to one airfoil stage and subsequently the next, serially, may be less than the total of two different cooling gas flow quantities provided to each airfoil stage in parallel.

For example, the inventors determined that approximately 90% of the cooling gas flow that would be supplied to a turbine vane and a turbine blade in a parallel cooling arrangement is required to provide adequate cooling to the same turbine vane and turbine blade when the cooling gas flow is provided in serial fashion. Thus, although the total cooling gas flow is less in the serial cooling arrangement set forth herein, each airfoil stage receives a greater flow rate of the cooling gas. Although the cooling air may be heated as it passes through the first airfoil, the increased flow quantity, as compared to a parallel cooling arrangement, may be more than sufficient to make up for the temperature rise, and hence still provides adequate cooling to both the first and second airfoil.

In addition, the cooling gas flow employed in the present serial cooling arrangement naturally has a greater heat dissipation capacity, e.g., cooling effectiveness, due to the increased mass flow rate, which may thus allow the use of a simpler airfoil cooling scheme. For example, the inventors determined that, due to the greater cooling effectiveness afforded by the larger amount of cooling gas flow, turbulators 82 in the form of ribs may be employed to adequately cool turbine vane 28, instead of an impingement tube and pin fin or other heat transfer members arrangement that were required to maintain acceptable metal temperatures in a parallel cooling arrangement. This may reduce the cost of the turbine airfoil arrangement, as well as increase reliability. For example, by using turbulators instead of an impingement tube and pin fins, leakages associated with the use of impingement tubes may be avoided, the cost of the impingement tube and associated mounting structure may be avoided, and the cost differential as between pin fins and turbulator ribs may be avoided.

In the embodiment described above, the turbine airfoils that are cooled in serial fashion are a second stage turbine vane and a second stage turbine blade, wherein the cooling gas flow first cools the turbine vane and then cools the turbine blade. However, the present invention is not so limited. Rather, airfoils of any stage may be cooled in serial fashion in accordance with embodiments of the present invention.

Figure 6:
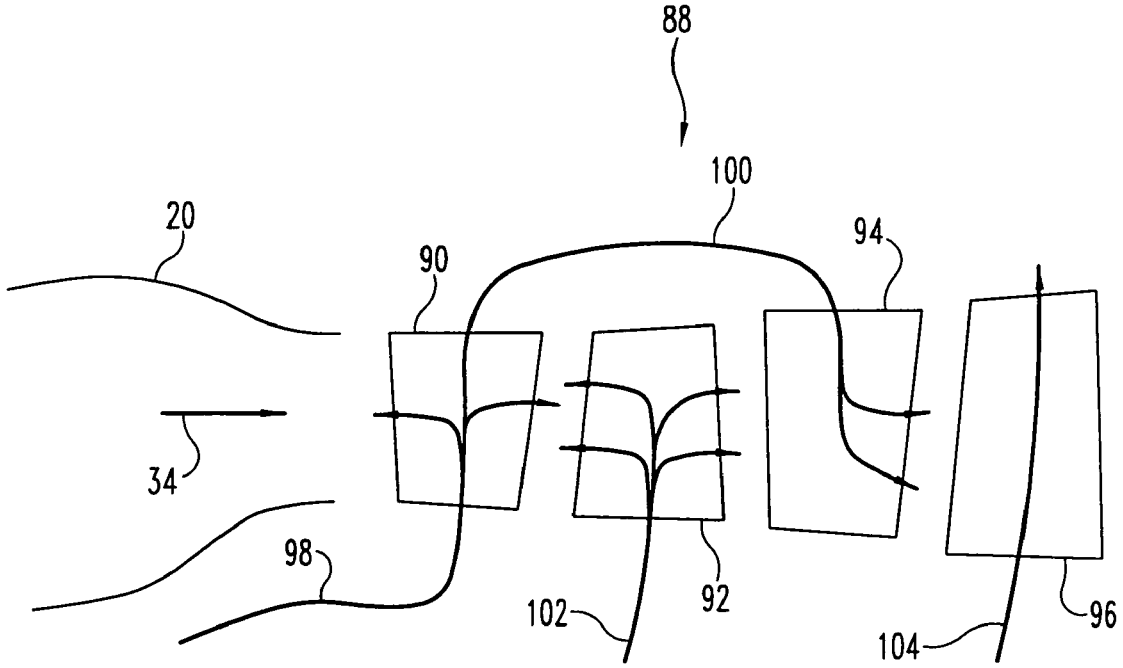
FIG. 6 schematically depicts the cooling of turbine airfoils in serial fashion in accordance with another embodiment of the present invention.

For example, referring now to FIG. 6, another embodiment of the present invention is schematically depicted. In the embodiment of FIG. 6, a turbine airfoil arrangement 88 includes a first stage turbine vane 90, a first stage turbine blade 92, a second stage turbine vane 94 and a second stage turbine blade 96. First stage turbine vane 90 is located immediately downstream of combustor 20 in main gas path direction 34, followed by first stage turbine blade 92, second stage turbine vane 94 and second stage turbine blade 96.

A cooling gas flow 98 is first directed through turbine vane 90 for cooling thereof, and at least some of cooling gas flow 98 exiting turbine vane 90, e.g., portion 100 of cooling gas flow 98, is directed through turbine vane 94 for cooling thereof. Turbine airfoil arrangement 88 represents a serial/parallel cooling arrangement, wherein turbine vane 90 and turbine vane 94 are cooled in serial fashion, similar to that as set forth in the embodiment of FIGS. 1-5, and turbine blade 92 and turbine blade 96 are cooled in parallel fashion using separate cooling gas flows 102 and 104.

The present application contemplates a turbine airfoil arrangement, comprising an airfoil having an inlet and an exit, the inlet configured to receive a cooling gas flow operable to cool at least part of an other airfoil, and a passage disposed in the airfoil and fluidly coupled to the inlet and the exit, the exit being configured to pass a portion of the cooling gas flow to the other airfoil.

The present application further contemplates a gas turbine engine, comprising a compressor, and a turbine, the turbine including a turbine airfoil arrangement cooled by a cooling gas flow from said compressor, the turbine airfoil arrangement comprising an airfoil, an inlet in the airfoil and configured to receive the cooling gas flow, a passage in the airfoil and fluidly coupled to the inlet, and an exit in the airfoil and fluidly coupled to the passage, the exit configured to allow passage of some of the cooling gas flow to an other airfoil.

Yet another aspect of the present application further contemplates a method of cooling a gas turbine engine turbine airfoil arrangement, comprising extracting from a compressor of the gas turbine engine a cooling gas flow suitable in temperature and quantity to cool a first airfoil and a second airfoil, directing the cooling gas flow to the first airfoil and the second airfoil in serial fashion, wherein the first airfoil internally receives the cooling gas flow, and wherein the second airfoil internally receives a remaining portion of the cooling gas flow discharged from the first airfoil, directing a first amount of heat energy from the first airfoil using the cooling gas flow, and directing a second amount of heat energy from the second airfoil using the remaining portion of the cooling gas flow subsequent to directing the first amount of heat energy from the first airfoil.

Yet another aspect of the present application further contemplates a gas turbine engine comprising a compressor operable to produce a gas flow useable for cooling, a turbine having at least two stages of airfoils, and means for serially cooling the at least two stages of airfoils.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures as permitted under the law.

Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one," "at least some" and "at least a portion" are used, there is no intention to limit the claim to only one item unless specifically stated to the contrary in the claim. Further, when the language "at least some" and/or "some" and/or "at least a portion" and/or "a portion" is used, the item may include a portion and/or the entire item unless specifically stated to the contrary. The terms "first" and "second", etc., preceding an element name, e.g., first airfoil, second airfoil, etc., are used for identification purposes to distinguish between elements, results or concepts, and are not intended to necessarily imply order, nor are the terms "first" and "second" intended to preclude the inclusion of additional similar or related elements, results or concepts, unless otherwise indicated.

What is claimed is:

1. A turbine airfoil arrangement, comprising:

an airfoil having an inlet and an exit, said inlet configured to receive a cooling gas flow operable to cool at least part of an other airfoil; and a passage disposed in said airfoil and fluidly coupled to said inlet and said exit, said exit being configured to pass a portion of the cooling gas flow to the other airfoil, further comprising:

a second airfoil, wherein said second airfoil is the other airfoil; and a second passage disposed in said second airfoil and fluidly coupled to said exit, said second passage being configured to receive the portion of the cooling gas flow and to cool said at least part of said second airfoil using the portion of the cooling gas flow, further comprising:

a first seal;

a second seal; and a cavity disposed between said first seal and said second seal, said cavity fluidly coupling said exit and said second passage.

2. A turbine airfoil arrangement, comprising:

an airfoil having an inlet and an exit, said inlet configured to receive a cooling gas flow operable to cool at least part of an other airfoil; and a passage disposed in said airfoil and fluidly coupled to said inlet and said exit, said exit being configured to pass a portion of the cooling gas flow to the other airfoil, further comprising:

a second airfoil, wherein said second airfoil is the other airfoil;

a first seal; a second seal; and a cavity disposed between said first seal and said second seal; and a second passage disposed in said second airfoil and fluidly coupled to said exit via said cavity, said second passage being configured to receive the portion of the cooling gas flow and to cool said at least part of said second airfoil using the portion of the cooling gas flow, wherein each of said airfoil and said second airfoil are configured as a turbine vane.

3. A gas turbine engine, comprising:

a compressor; and a turbine, said turbine including a turbine airfoil arrangement cooled by a cooling gas flow from said compressor, said turbine airfoil arrangement comprising:

an airfoil;

an inlet in said airfoil and configured to receive the cooling gas flow;

a passage in said airfoil and fluidly coupled to said inlet;

an exit in said airfoil and fluidly coupled to said passage;

a first seal; a second seal; and a cavity disposed between said first seal and said second seal, said exit configured to allow passage of some of the cooling gas flow to an other airfoil via said cavity.

4. The gas turbine engine of claim 3, wherein one of said inlet and said exit is sized to control the cooling gas flow that passes through said airfoil via said exit.

5. The gas turbine engine of claim 3, wherein said turbine airfoil arrangement further comprising:

a second airfoil, wherein said second airfoil is the other airfoil; and a second passage disposed in said second airfoil and fluidly coupled to said exit, said second passage configured to receive some of the cooling gas flow and to cool said at least part of the second airfoil using some of the cooling gas flow.

6. The gas turbine engine of claim 5, said turbine airfoil arrangement further comprising a cover plate configured to direct some of the cooling gas flow to said second passage.

7. The gas turbine engine of claim 5, wherein each of said airfoil and said second airfoil are configured as a turbine vane.

8. The gas turbine engine of claim 5, wherein said first airfoil is configured as a turbine vane and said second airfoil is configured as a turbine blade.

9. The gas turbine engine of claim 5, wherein said passage is configured to provide cooling for at least a part of said airfoil using the cooling gas flow, and where said airfoil and said second airfoil are cooled in serial fashion by the cooling gas flow.

10. A method of cooling a gas turbine engine turbine airfoil arrangement, comprising:

extracting from a compressor of the gas turbine engine a cooling gas flow suitable in temperature and quantity to cool a first airfoil and a second airfoil;

directing the cooling gas flow to the first airfoil and the second airfoil in serial fashion, wherein the first airfoil internally receives the cooling gas flow, and wherein the second airfoil internally receives a remaining portion of the cooling gas flow discharged from the first airfoil via a cavity disposed between a first seal and a second seal;

directing a first amount of heat energy from the first airfoil using the cooling gas flow; and directing a second amount of heat energy from the second airfoil using the remaining portion of the cooling gas flow subsequent to said directing the first amount of heat energy from the first airfoil.

11. The method of claim 10, further comprising flowing the remaining cooling gas flow downstream to the second airfoil.

12. The method of claim 10, further comprising flowing the remaining cooling gas flow upstream to the second airfoil.

13. The method of claim 10, further comprising:

directing the remaining portion of the cooling gas flow between the first seal and the second seal, the first seal and the second seal forming the cavity between a rotating component of the gas turbine engine and a stationary component of the gas turbine engine; and receiving the remaining portion of the cooling gas flow at the second airfoil from the cavity.

14. The method of claim 13, wherein said directing the remaining portion of the cooling gas flow between the first seal and the second seal includes preswirling the remaining portion of the cooling gas flow.

15. A gas turbine engine comprising:

a compressor operable to produce a gas flow useable for cooling;

a turbine having at least two stages of airfoils; and means for serially cooling said at least two stages of airfoils a first seal; a second seal; and a cavity disposed between said first seal and said second seal; and means for serially coolin said at least two stages of airfoils via said cavity.

* * * * *